US011742580B2

(12) United States Patent
Pajona

(10) Patent No.: US 11,742,580 B2
(45) Date of Patent: Aug. 29, 2023

(54) MULTIFEED ANTENNA SYSTEM WITH CAPACITIVELY COUPLED FEED ELEMENTS

(71) Applicant: Kyocera AVX Components (San Diego), Inc., San Diego, CA (US)

(72) Inventor: Olivier Pajona, Antibes (FR)

(73) Assignee: Kyocera AVX Components (San Diego), Inc., San Diego, CA (US)

( * ) Notice: Subject to any disclaimer, the term of this patent is extended or adjusted under 35 U.S.C. 154(b) by 0 days.

(21) Appl. No.: 17/358,379

(22) Filed: Jun. 25, 2021

(65) Prior Publication Data

US 2022/0037788 A1 Feb. 3, 2022

Related U.S. Application Data

(60) Provisional application No. 63/057,308, filed on Jul. 28, 2020.

(51) Int. Cl.

| | |
|---|---|
| ***H01Q 7/00*** | (2006.01) |
| ***H01Q 1/48*** | (2006.01) |
| ***H01Q 5/328*** | (2015.01) |
| ***H01Q 5/307*** | (2015.01) |
| ***H01Q 5/335*** | (2015.01) |

(52) U.S. Cl.

CPC ..... *H01Q 7/005* (2013.01); *H01Q 1/48* (2013.01); *H01Q 5/307* (2015.01); *H01Q 5/328* (2015.01); *H01Q 5/335* (2015.01)

(58) Field of Classification Search

CPC ..... H01Q 9/27; H01Q 1/521; H01Q 1/52; H01Q 9/42

See application file for complete search history.

(56) References Cited

U.S. PATENT DOCUMENTS

| | | | | |
|---|---|---|---|---|
| 6,456,243 | B1 | 9/2002 | Poilasne et al. | |
| 6,717,551 | B1 | 4/2004 | Desclos et al. | |
| 6,744,410 | B2 | 6/2004 | Shamblin et al. | |
| 6,943,730 | B2 | 9/2005 | Poilasne et al. | |
| 7,663,556 | B2 | 2/2010 | Desclos et al. | |
| 7,696,932 | B2 | 4/2010 | Desclos et al. | |
| 2012/0285611 | A1* | 11/2012 | Desclos | H01Q 1/40 156/222 |
| 2015/0048991 | A1* | 2/2015 | Pajona | H01Q 7/00 343/866 |

FOREIGN PATENT DOCUMENTS

| | | |
|---|---|---|
| WO | WO03092118 | 11/2003 |

* cited by examiner

*Primary Examiner* — Ricardo I Magallanes
(74) *Attorney, Agent, or Firm* — Dority & Manning, P.A.

(57) ABSTRACT

An antenna system, such as a multifeed antenna system, can include at least one antenna feed element. The antenna system can include an antenna loop element. The at least one antenna feed element can be capacitively coupled to the antenna loop element. The at least one antenna feed element can include one or more capacitively coupled regions. The one or more capacitively coupled regions can form at least a portion of the capacitive coupling of the at least one antenna feed element to the antenna loop element.

14 Claims, 5 Drawing Sheets

MULTIFEED ANTENNA SYSTEM WITH CAPACITIVELY COUPLED FEED ELEMENTS

PRIORITY CLAIM

The present application claims the benefit of priority of U.S. Provisional App. No. 63/057,308, titled "Multifeed Antenna System with Capacitively Coupled Feed Elements," having a filing date of Jul. 28, 2020, which is incorporated by reference herein.

FIELD

Example aspects of the present disclosure relate generally to the field of antenna systems, such as, for example, multifeed antenna systems with capacitively coupled feed elements.

BACKGROUND

Antenna systems can propagate and/or receive electromagnetic waves that are transmitted through the air and/or other materials from a source to a destination. Various material types can impact the manner in which electromagnetic waves are propagated.

SUMMARY

Aspects and advantages of embodiments of the present disclosure will be set forth in part in the following description, or can be learned from the description, or can be learned through practice of the embodiments.

One example aspect of the present disclosure is directed to an antenna system, such as a multifeed antenna system. The antenna system can include at least one antenna feed element. The antenna system can include an antenna loop element. The at least one antenna feed element can be capacitively coupled to the antenna loop element. The at least one antenna feed element can include one or more capacitively coupled regions. The one or more capacitively coupled regions can form at least a portion of the capacitive coupling of the at least one antenna feed element to the antenna loop element.

Another example aspect of the present disclosure is directed to a mobile device configured for RF communications. The mobile device can include a screen configured to display information to a user. The mobile device can include one or more user input components configured to receive input from the user. The mobile device can include one or more memory devices configured to store computer-interpretable data. The mobile device can include a processor configured to perform computing instructions. The mobile device can include an antenna system, such as an antenna system including at least one antenna feed element having one or more capacitively coupled regions and an antenna loop element capacitively coupled to the at least one antenna feed element.

Other aspects of the present disclosure are directed to various systems, apparatuses, non-transitory computer-readable media, user interfaces, and electronic devices.

These and other features, aspects, and advantages of various embodiments of the present disclosure will become better understood with reference to the following description and appended claims. The accompanying drawings, which are incorporated in and constitute a part of this specification, illustrate example embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

Figure 1:
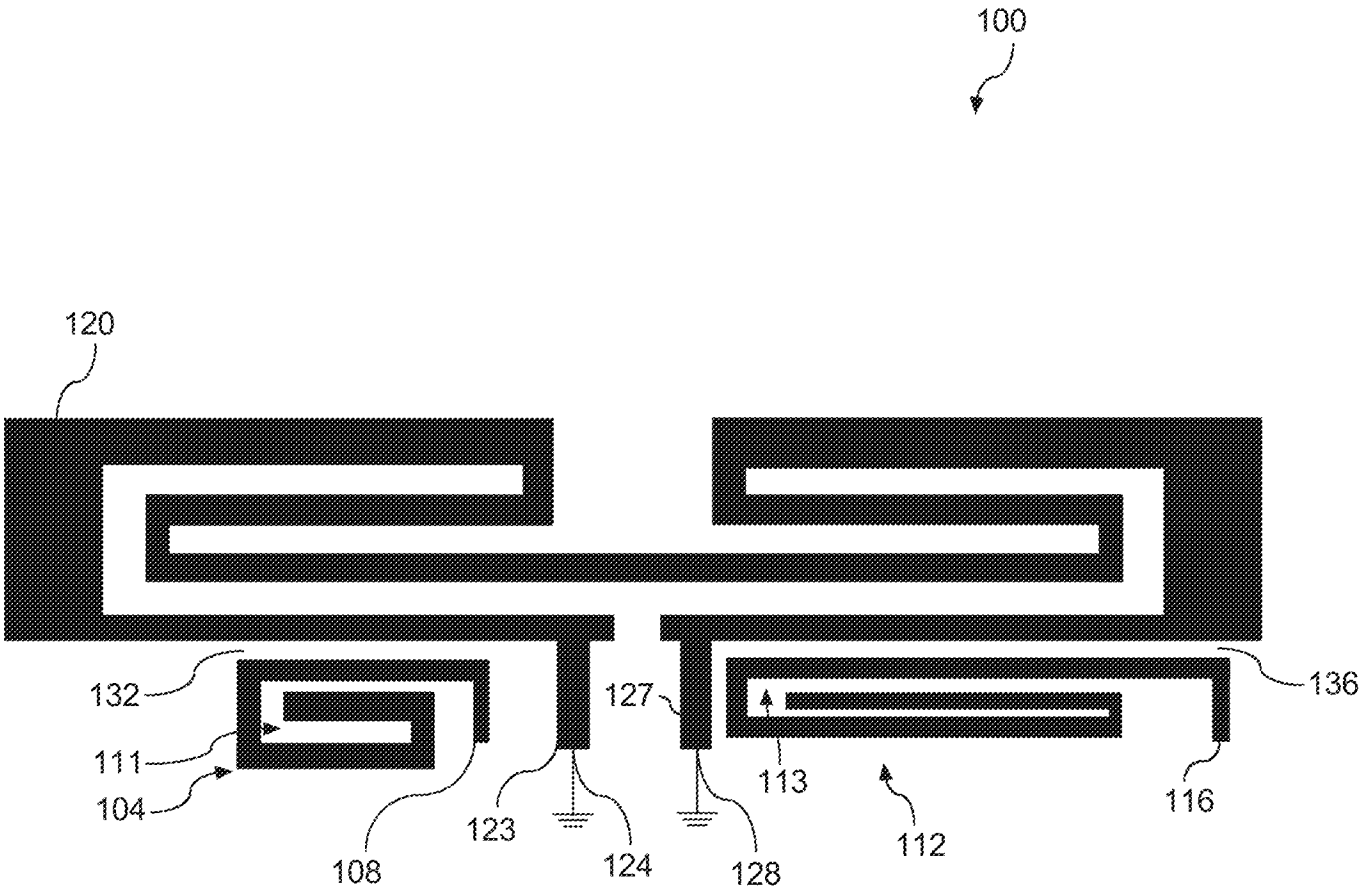
FIG. 1 illustrates an example multifeed antenna system having a plurality of antenna feed elements having one or more capacitively coupled regions according to example embodiments of the present disclosure.

Reference numerals that are repeated across plural figures are intended to identify the same features in various implementations.

DETAILED DESCRIPTION

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to antenna systems used for radiofrequency (RF) communications. For many devices, such as mobile devices, spatial constraints can limit effectiveness of an antenna system used for RF communications. For instance, constraints can be imposed on volumes and/or shapes of spaces that may be occupied by antenna systems and/or related circuitry (e.g. RF circuitry, control circuitry, etc.). For instance, it may be preferable in some cases to employ a multifeed antenna that includes an antenna loop element coupled (e.g., capacitively coupled) to a plurality of antenna feed elements, which can contribute to a reduced footprint (e.g., a total amount and/or certain dimension of occupied space) of the antenna system.

Example aspects of the present disclosure can provide for improved antenna systems. For instance, example aspects of the present disclosure are directed to an antenna system (e.g., a multifeed antenna system) for RF communications. The antenna system can be a multifeed antenna system, such as an antenna system including a plurality of antenna feed elements. The antenna system can include any number (e.g., any plurality) of antenna feed elements, such as one or more antenna feed elements, such as two or more antenna feed elements.

The antenna feed elements can be coupled (e.g., capacitively coupled) to an antenna loop element. The antenna loop element can be configured to transmit and/or receive RF signals (e.g., electromagnetic signals, such as radiated signals) based on feed signals at the antenna feed elements. For instance, the antenna loop element can be configured to radiate signals based on feed signals at each of the antenna feed elements. As one example, the antenna loop element can form a current path. The antenna loop element (e.g., the current path) can interact with feed signals at the antenna feed elements. In some embodiments, the antenna loop element can be a folded antenna loop element. The antenna loop element can include, for example, one or more bends in the antenna loop element (e.g., the current path). In some embodiments, the antenna loop element can be planar, such as formed of one or more primarily two-dimensional metal sheets.

The antenna loop element can act as a "common" radiating element for a plurality of antenna feed elements, such as at a plurality of frequency bands (e.g., for a plurality of communication functions). Thus, devices including the antenna system having a common radiating element formed by the antenna loop element can experience a reduced footprint of the antenna system. For instance, devices including the antenna system as described herein can avoid dedicating space for a plurality of unique antenna systems (e.g., each configured for a specific frequency band and/or communication function) each including a unique antenna radiating element. For instance, harmonics of a lowest resonance frequency of the antenna radiating element can be configured for a first RF circuitry. Using the antenna radiating element as a common radiating element for a plurality of antenna feed elements can allow the harmonics to be reused by at least a second RF circuitry without requiring unique radiating element(s) for the second RF circuitry. This can contribute to space and/or complexity savings associated with the omittance of a plurality of radiating elements.

According to example aspects of the present disclosure, the antenna feed element(s) can be or can include one or more electromagnetically coupled regions. For instance, the electromagnetically coupled regions can be or can include one or more capacitively coupled regions. The electromagnetically coupled regions (e.g., capacitively coupled regions) can provide electromagnetic coupling within the antenna feed elements. For instance, the electromagnetically coupled regions can define electromagnetic coupling between one or more portions, segments, etc. of the antenna feed element, such as even in the absence of external components (e.g., the antenna loop element). Additionally, the electromagnetically coupled regions (e.g., capacitively coupled regions) can provide improved capacitive coupling between the antenna feed elements and the antenna loop element. The improved capacitive coupling can improve performance of the antenna system, such as by providing stronger effects of the feed signals on the current loop formed by the antenna loop element and/or other advantages.

As one example, the antenna feed elements having electromagnetically coupled region(s) can be or can include isolated magnetic dipole (IMD) antenna feed elements. For instance, the isolated magnetic dipole antenna feed elements can each include at least one capacitively coupled region. For instance, in some embodiments, the isolated magnetic dipole antenna feed elements can include a spiral planar portion to form the isolated magnetic dipole. In some embodiments, the antenna feed elements can be planar, such as formed of primarily two-dimensional metal sheets.

The antenna feed elements can each be configured for RF signal transmission and/or RF signal reception, such as at a particular frequency and/or particular band of frequencies. For instance, each of the antenna feed elements can be individually and/or collectively configured to perform RF communications. As an example, each of the antenna feed elements can be configured to provide signals within a different frequency band, such as across at least a portion of a frequency band. For example, in some implementations, a first antenna feed element can be associated with (e.g., configured to receive and/or provide signals at) a first frequency (e.g., a first frequency band) and/or a second antenna feed element can be associated with (e.g., configured to receive and/or provide signals at) a second frequency (e.g., second frequency band). The second frequency can be different from the first frequency.

Additionally and/or alternatively, in some embodiments, the electromagnetically coupled regions (e.g., capacitively coupled regions) can provide frequency filtering at the antenna feed elements. For example, dimensions and/or other characteristics of the electromagnetically coupled regions (e.g., capacitively coupled regions), such as, for example, gap width, length, trace width, etc., can be selected such that the regions provide frequency filtering. The frequency filtering can improve isolation between each of a plurality of antenna feed elements. For example, an antenna feed element can be designed to be resistive to oscillating electrical signals at frequencies other than a select frequency and/or frequency band(s) which the antenna feed element is intended to use. As one example, in some embodiments, a first antenna feed element of a plurality of antenna feed elements can be associated with (e.g., configured to resonate signals at) a first frequency. Additionally, a second antenna feed element of the plurality of antenna feed elements can be associated with a second frequency. The second frequency can be different (e.g., have little to no overlap) from the first frequency. The first antenna feed element can be configured to filter the second frequency. For example, the first antenna feed element can be configured to not react to signals at the second frequency and/or have reduced attenuation to signals at the second frequency.

As one example, the antenna system can be implemented in a mobile device, such as a cell phone, smart phone, tablet computer, laptop computer, pager, personal digital assistant, or any other suitable mobile device. The mobile device can be configured for RF communications. The mobile device can include a screen configured to display information to a user. Additionally and/or alternatively, the mobile device can include one or more user input components configured to receive input from the user. Additionally and/or alternatively, the mobile device can include one or more memory devices configured to store computer-interpretable data. Additionally and/or alternatively, the mobile device can include a processor configured to perform computing instructions. Additionally and/or alternatively, the mobile device can include a multifeed antenna system according to example aspects of the present disclosure, such as a multifeed antenna system including a plurality of antenna feed elements and an antenna loop element. The plurality of antenna feed elements can be capacitively coupled to the antenna loop element. The plurality of antenna feed elements can include one or more capacitively coupled regions that increase capacitive coupling of at least one of the plurality of antenna feed elements to the antenna loop element.

The antenna system can be configured to receive and/or transmit some or all wireless (e.g., radiofrequency) signals for operation of the mobile device, such as, for instance, cellular signals, Bluetooth signals, Wi-Fi signals, RFID signals, and/or any other suitable signals, and/or combination thereof. For instance, in some embodiments, the antenna system (e.g., each of the antenna feed elements) can be coupled to RF circuitry. The RF circuitry can include various circuitry (e.g., modulators, control circuitry, signal processing, upsamplers and/or downsamplers, etc.) configured to provide a suitable RF signal to the antenna feed elements for transmission and/or prepare a received signal from the antenna feed elements for various downstream circuitry (e.g., a processor of a mobile device).

The antenna system (e.g., antenna feed element(s)) can be configured for RF signal transmission and/or RF signal reception. For instance, the antenna system (e.g., antenna feed element(s)) can be configured to perform RF communications. As one example, the antenna system (e.g., antenna feed element(s)) can be implemented in a mobile device, such as a cell phone, smart phone, tablet computer, laptop computer, pager, personal digital assistant, or any other suitable mobile device. For instance, the mobile device can include a screen configured to display information to a user and/or receive input from the user. As another example, the mobile device can include one or more processors (e.g., baseband processors) configured to perform computations associated with operation of the mobile device. As another example, the mobile device can include telecommunication circuitry (e.g., RF circuitry) configured to provide telecommunications, such as voice communications (e.g., telephone services) and/or other communications (e.g., textual communications, such as SMS).

The antenna system (e.g., antenna feed element(s)) can be configured to receive and/or transmit some or all wireless (e.g., radiofrequency) signals for operation of the mobile device, such as, for instance, cellular signals, Bluetooth signals, Wi-Fi signals, RFID signals, and/or any other suitable signals, and/or combination thereof. For instance, in some embodiments, the antenna system (e.g., antenna feed element(s)) can be coupled to RF circuitry. The RF circuitry can include various components (e.g., a front-end module, modulators, etc.) configured to provide RF signals to and/or from the antenna system (e.g., antenna feed element(s)), such as to enable telecommunication and/or other functions of a mobile device.

Antenna systems according to example aspects of the present disclosure can provide a number of technical effects and benefits. For instance, the use of an antenna loop element as a common radiating structure for a plurality of antenna feed elements, such as antenna feed elements at a plurality of different frequencies and/or for a plurality of different communication tasks, can provide for a reduced footprint of antenna systems, such as, for instance, in mobile device applications and/or other suitable applications. Furthermore, the use of an isolated magnetic dipole feed element can reduce detuning caused by, for instance, background materials, other RF-capable devices, device positioning, etc. Additionally and/or alternatively, the use of an isolated magnetic dipole feed element can strengthen capacitive coupling to the antenna loop element due to the capacitively coupled regions at the IMD feed element, which can provide for, for example, improved signal sensitivity and/or other performance (e.g., with a reduced and/or constant footprint). For example, by including capacitively coupled regions at the feed element, capacitive coupling to the antenna loop element can be increased relative to a consistent footprint (e.g., consistent length) of the feed element. Additionally and/or alternatively, a footprint of the feed element (e.g., a length of the feed element) can be reduced while maintaining comparable performance qualities.

Referring now to the FIGS., example aspects of the present disclosure will be discussed in detail. One of ordinary skill in the art should understand that the example embodiments depicted in the FIGS. are for the purposes of illustration only, and that components depicted therein can be changed, modified, omitted, duplicated, or otherwise be changed in accordance with example aspects of the present disclosure.

FIG. 1 illustrates an example multifeed antenna system 100 according to example embodiments of the present disclosure. The multifeed antenna system 100 can include a plurality of conductive elements (e.g., the first feed element 104, second feed element 112, antenna loop element 120, etc.) that may be printed on a dielectric material, such as, for example, FR4, plastic, ceramic, and/or any other suitable dielectric material. For example, the multifeed antenna can be formed at least partially on a block (e.g., a dielectric block), a substrate (e.g., a flexible substrate and/or rigid substrate) and/or any other suitable surface.

The multifeed antenna system 100 can include a plurality of antenna feed elements. For instance, multifeed antenna system 100 includes two antenna feed elements including first feed element 104 and second feed element 112. For instance, multifeed antenna system 100 includes first feed element 104 having one end portion as a first feed point 108 coupled to an RF signal source (e.g., RF circuitry) and a second feed element 112 having one end portion as a second feed point 116 coupled to an RF signal source (e.g., RF circuitry). Any suitable number of antenna feed elements can be employed in multifeed antenna systems according to example aspects of the present disclosure. For example, multifeed antenna systems can include three or more feed elements according to example aspects of the present disclosure.

The multifeed antenna system 100 can include antenna loop element 120. For instance, antenna loop element 120 can be a folded loop element. The antenna loop element 120 can be configured to include a first grounding portion 123 having a first end portion 124 shorted to ground, and a second grounding portion 127 having a second end portion 128 shorted to ground. In some embodiments, one of the first and second end portions 124 and 128 may be shorted to ground, while the other end portion is kept open. Additionally and/or alternatively, the grounding portions 123 and 127 may be merged into one without the gap in between to provide one end portion shorted to ground.

The antenna feed elements 104, 112 can be coupled (e.g., capacitively coupled) to antenna loop element 120. The antenna loop element 120 can be configured to transmit and/or receive RF signals (e.g., electromagnetic signals, such as radiated signals) based on feed signals at the antenna feed elements 104, 112. For instance, the antenna loop element 120 can be configured to radiate signals based on feed signals at each of the antenna feed elements 104, 112. As one example, the antenna loop element 120 can form a current path. The antenna loop element 120 (e.g., the current path) can interact with feed signals at the antenna feed elements 104, 112.

The first feed element 104 can be capacitively coupled through a first gap 132 to the antenna loop element 120. Additionally and/or alternatively, the second feed element 112 can be capacitively coupled through a second gap 136 to the antenna loop element 120. Thus, these two feed elements 104 and 112 are capacitively coupled commonly to one antenna loop element 120. The shape and dimensions of each of the feed elements 104 and 112, as well as the width and length of each of the gaps 132 and 136, can be designed to accommodate design constraints and/or metrics, such as, for example, targeted resonances, bandwidths, and other performance metrics. For example, in some implementations, the first antenna feed element 104 can be separated from the antenna loop element 120 by first gap 132 having a first width, and second antenna feed element 112 can be separated from the antenna loop element by second gap 136 having a second width. The second width (e.g., the width of second gap 136) can be different from the first width (e.g., the width of first gap 132). Additionally and/or alternatively, in some implementations, the first feed element 104 may be configured to be shorter than the second feed element 112 such that higher frequency bands can be associated with the first feed element 104 than that of second feed element 112 and/or lower frequency bands can be associated with the second feed element 112 that that of first feed element 104.

The antenna loop element 120 can include, for example, one or more bends in the antenna loop element 120 (e.g., the current path). In some embodiments, the antenna loop element 120 can be planar, such as formed of one or more primarily two-dimensional metal sheets. For example, the antenna loop element 120 can be formed of a plurality of planar segments intersecting at one or more bends. The shape and dimensions of each segment and/or the number of bends of the antenna loop element 120 between the first end portion 124 and the second end portion 128 can be designed to accommodate design constraints and/or metrics, such as, for example, targeted resonances, bandwidths, and other performance metrics. FIG. 1 illustrates a symmetric antenna loop element 120. However, in some embodiments, antenna loop element 120 can be asymmetric. FIG. 1 illustrates an antenna loop element 120 having sharp corners. However, in some implementations, one or more rounded corners may be used in place of any of the sharp corners at bends of the antenna loop element 120. A width of segments of antenna loop element 120 can be varied. For instance, wide patches and/or thin meander lines may be used for some segments of the antenna loop element 120. As one example, in some implementations, the antenna loop element 120 can include a first segment having a first width and a second segment having a second width. The second width can be different from the first width.

The antenna loop element 120 can act as a "common" radiating element for a plurality of antenna feed elements 104, 112, such as at a plurality of frequency bands (e.g., for a plurality of communication functions). Thus, devices including the antenna system having a common radiating element formed by the antenna loop element 120 can experience a reduced footprint of the antenna system. For instance, devices including the multifeed antenna system 100 can avoid dedicating space for a plurality of unique antenna systems (e.g., each configured for a specific frequency band and/or communication function) each including a unique antenna radiating element.

According to example aspects of the present disclosure, the antenna feed element(s) 104, 112 can be or can include one or more electromagnetically coupled regions 111, 113. For instance, the electromagnetically coupled regions 111, 113 can be or can include one or more capacitively coupled regions. The electromagnetically coupled regions 111, 113 (e.g., capacitively coupled regions) can provide electromagnetic coupling within the antenna feed elements 104, 112. For instance, the electromagnetically coupled regions 111, 113 can define electromagnetic coupling at the antenna feed element, such as even in the absence of external components (e.g., the antenna loop element 120). Additionally, the electromagnetically coupled regions 111, 113 (e.g., capacitively coupled regions) can provide improved capacitive coupling between the antenna feed elements 104, 112 and the antenna loop element 120. The improved capacitive coupling can improve performance of the multifeed antenna system 100, such as by providing stronger effects of the feed signals on the current loop formed by the antenna loop element 120 and/or other advantages.

As illustrated in FIG. 1, the antenna feed elements 104, 112 having electromagnetically coupled region(s) are isolated magnetic dipole (IMD) antenna feed elements 104, 112. For instance, the isolated magnetic dipole antenna feed elements 104, 112 can each include at least one capacitively coupled region. For instance, in some embodiments, the isolated magnetic dipole antenna feed elements 104, 112 can include a spiral planar portion to form the isolated magnetic dipole. In some embodiments, the antenna feed elements 104, 112 can be planar, such as formed of primarily two-dimensional metal sheets.

The antenna feed elements 104, 112 can each be configured for RF signal transmission and/or RF signal reception, such as at a particular frequency and/or particular band of frequencies. For instance, each of the antenna feed elements 104, 112 can be individually and/or collectively configured to perform RF communications. As an example, each of the antenna feed elements 104, 112 can be configured to provide signals within a different frequency band, such as across at least a portion of a frequency band.

Figure 2:
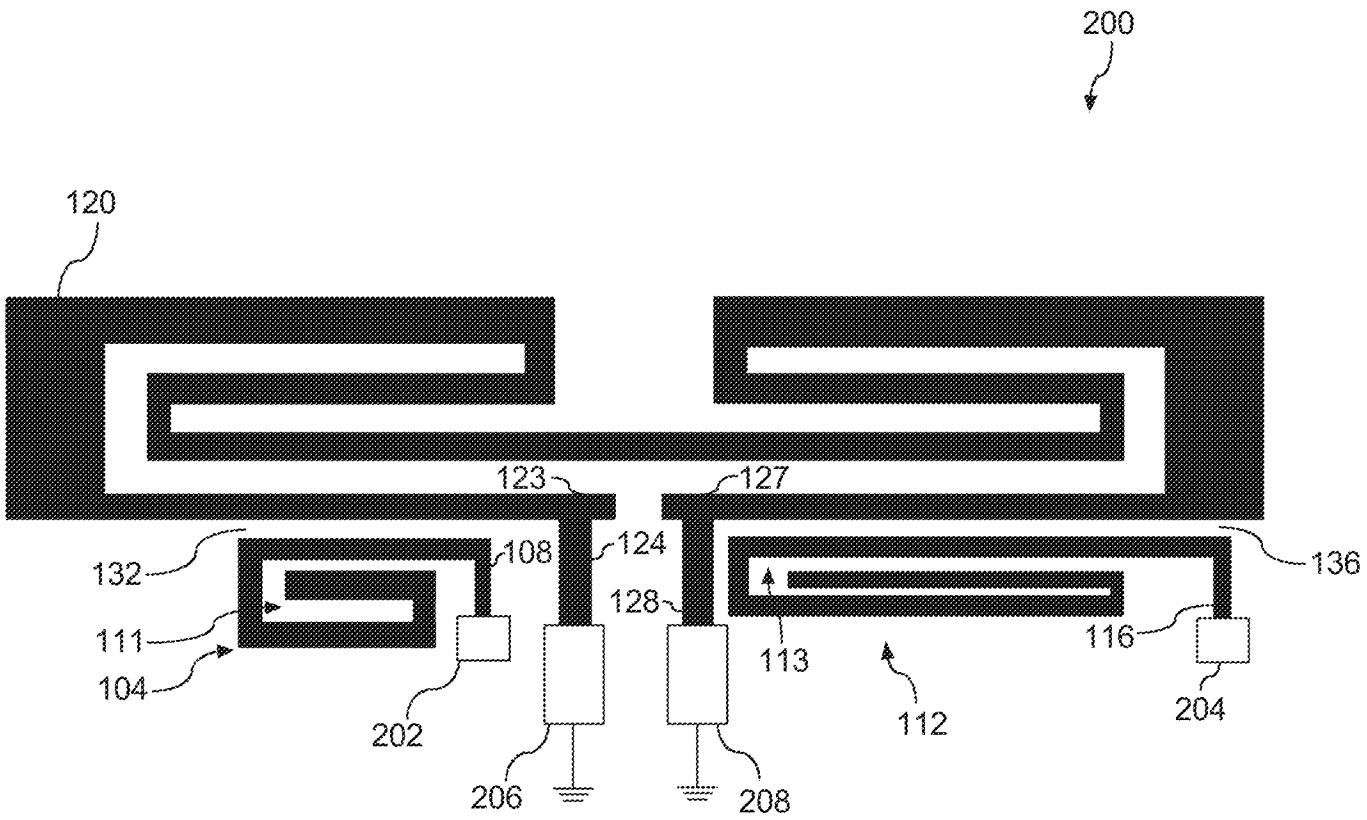
FIG. 2 illustrates an example multifeed antenna system having a plurality of antenna feed elements having one or more capacitively coupled regions according to example embodiments of the present disclosure.

FIG. 2 illustrates an example multifeed antenna system 200 according to example embodiments of the present disclosure. The multifeed antenna system 200 can include one or more components discussed with reference to multifeed antenna system 100 of FIG. 1, such as, for example, first feed element 104, second feed element 112, radiating loop 120, etc. Additionally, multifeed antenna system 200 can include feed tuning elements 202 and 204 and/or loop tuning elements 206 and 204. In some embodiments, one or more of the tuning elements 202, 204, 206, 208 can be omitted. For instance, some embodiments may include only a subset of tuning elements 202, 204, 206, 208.

Feed tuning elements (e.g., 202, 204) can be coupled to antenna feed elements (e.g., 104, 112). For instance, a first feed tuning element 202 can be coupled to first feed element 104. For example, first feed tuning element 202 can be coupled to first feed point 108 (e.g., as an RF signal source). Additionally and/or alternatively, a second feed tuning element 204 can be coupled to second feed element 112. For example, second feed tuning element 204 can be coupled to second feed point 116 (e.g., as an RF signal source). In some embodiments, first feed tuning element 202 can be disposed on a same substrate, in a same package, etc. as second feed tuning element 204.

The feed tuning elements 202, 204 can be configured to vary a signal connection to feed elements 104, 112 (e.g., a signal connection to RF circuitry). For example, the feed tuning elements 202, 204 can be or can include one or more tunable components configured to vary an electrical characteristic at the feed elements 104, 112. As one example, the one or more tunable components can be or can include tunable components configured to vary a resistance, capacitance, inductance, reactance, etc. at the feed elements 104, 112. As one example, the tunable components can be or can include active components, such as, for example, a varicap, varactor diode, varistor, etc. Additionally and/or alternatively, as another example, the feed tuning elements 202, 204 (e.g., the tunable components) can be or can include one or more switches (e.g., single pole switches) configured to selectively configure one or more signal connections from a plurality of candidate signal connections. For example, the plurality of candidate signal connections can each have a unique configuration of components (e.g., passive and/or active components, such as, for example, capacitors, inductors, resistors, wiring lengths, etc.) that provide unique electrical characteristics at the feed elements 104, 112. The switches can select one or more of the candidate signal connections to act as the signal connection (e.g., to RF circuitry). As one example, the feed tuning elements 202, 204 can be configured for tuning, impedance matching, etc. For instance, in some embodiments, the feed tuning elements 202, 204 can provide impedance loading or other electrical characteristic adjustment such that the multifeed antenna system 200 can be tuned to compensate for, and/or mitigate (e.g., counteract) interference effects arising from environments or conditions, such as when a head or a hand is placed in the proximity of the device.

Loop tuning elements (e.g., 206, 208) can be coupled to antenna loop element 120. For instance, a first loop tuning element 206 can be coupled to first end portion 124. Additionally and/or alternatively, a second loop tuning element 208 can be coupled to second end portion 128. In some embodiments, first loop tuning element 206 can be disposed on a same substrate, in a same package, etc. as second loop tuning element 208. Additionally and/or alternatively, in some embodiments, one or both of the loop tuning elements 206, 208 can be disposed on a substrate, in a same package, etc. as one or both of the feed tuning elements 202, 204.

The loop tuning elements 206, 208 can be configured to vary one or more ground connections to antenna loop element 120. For example, the loop tuning elements 206, 208 can be or can include one or more tunable components configured to vary an electrical characteristic at the antenna loop element 120. As one example, the one or more tunable components can be or can include tunable components configured to vary a resistance, capacitance, inductance, reactance, etc. at the antenna loop element 120. As one example, the tunable components can be or can include active components, such as, for example, a varicap, varactor diode, varistor, etc. Additionally and/or alternatively, as another example, the loop tuning elements 206, 208 (e.g., the tunable components) can be or can include one or more switches (e.g., single pole switches) configured to selectively configure one or more ground connections from a plurality of candidate ground connections. For example, the plurality of candidate ground connections can each have a unique configuration of components (e.g., passive and/or active components, such as, for example, capacitors, inductors, resistors, wiring lengths, etc.) that provide unique electrical characteristics at the antenna loop element 120 (e.g., at the end portions 124, 128). The switches can select one or more of the candidate ground connections to act as the ground connection (e.g., to RF circuitry).

In some embodiments, multifeed antenna systems according to example aspects of the present disclosure can be planar antenna systems. For example, planar antenna systems can be spatially arranged similarly to the illustrations of FIGS. 1 and 2. For instance, two or more feed elements can be included in the antenna, and each feed element configured to be capacitively coupled, directly and/or indirectly, to a common antenna loop element. The feed elements and/or antenna loop element can be disposed in a planar configuration, such as on a common (e.g., planar) substrate. In some embodiments, multifeed antenna systems according to example aspects of the present disclosure can be configured to be three-dimensional. For instance, three-dimensional antenna systems can be formed in empty space, formed on surfaces of a dielectric block, etc. The three-dimensional antenna systems can present a more desirable spatial profile for some implementations.

Figure 3A:
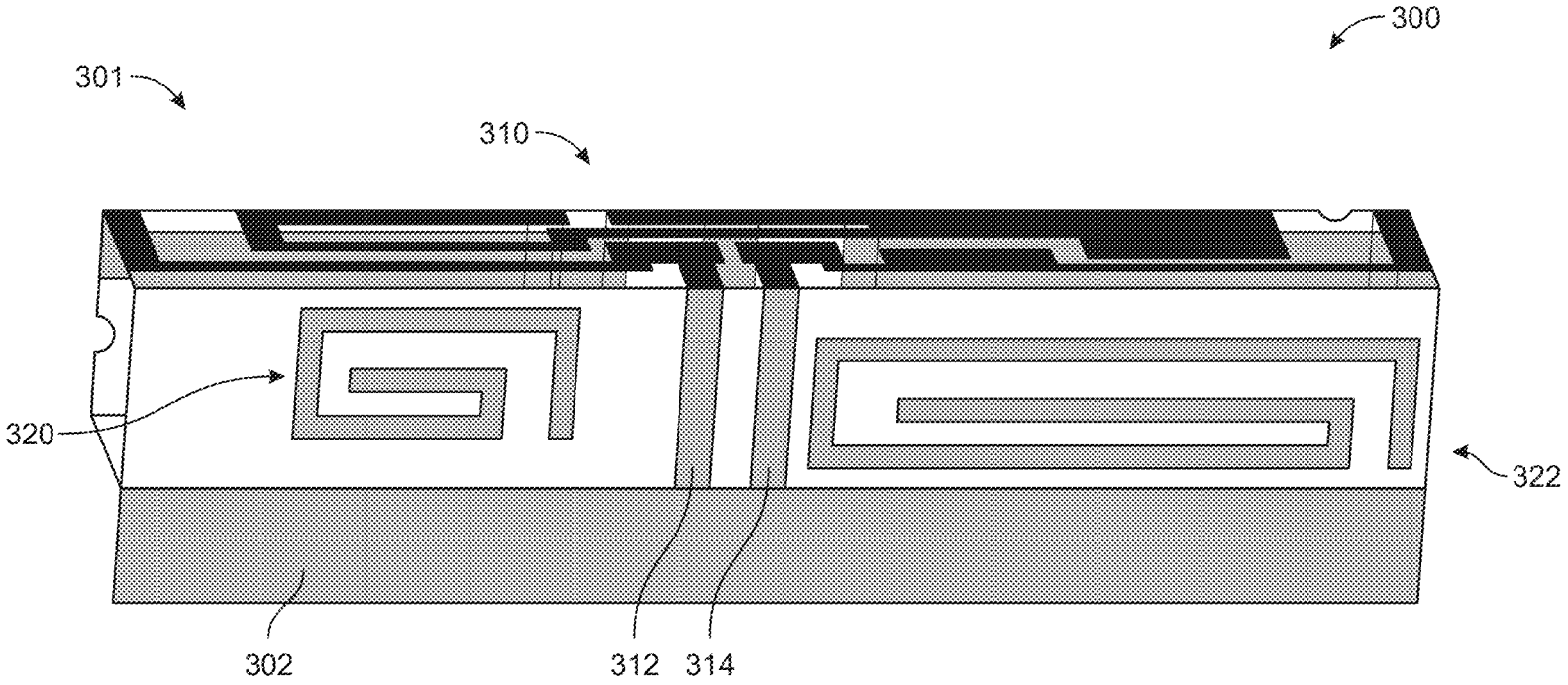
FIG. 3A illustrates an example three-dimensional multifeed antenna system having a plurality of antenna feed elements having one or more capacitively coupled regions according to example embodiments of the present disclosure.

FIG. 3A illustrates an example of a three-dimensional multifeed antenna system 300 according to example aspects of the present disclosure. For instance, multifeed antenna system 300 can include components discussed above, such as with respect to FIGS. 1 and 2. For instance, multifeed antenna system 300 can include an antenna loop element 310, a first feed element 320, and/or a second feed element 322. The first feed element 320 and/or second feed element 322 can include one or more electromagnetically coupled regions (e.g., one or more capacitively coupled regions. For example, the first feed element 320 and/or the second feed element 322 can be or can include isolated magnetic dipole feed elements. The first feed element 320 and/or the second feed element 322 can be capacitively coupled to the antenna loop element 310.

Antenna loop element 310, first feed element 320, and/or second feed element 322 can be disposed on one or more surfaces of a three-dimensional support structure 301. Three-dimensional support structure 301 can be or can include, for example, air (e.g., from structural support provided by the elements themselves), polystyrene, dielectric material such as, for example, FR4, ceramic, plastic, other suitable dielectric material, and/or any other suitable material, or combination thereof. For example, in some implementations, the three-dimensional support structure 301 can be or can include a dielectric block.

As one example, the three-dimensional support structure 301 can be or can include a block defining three pairs of spaced apart and/or opposite surfaces. For instance, the first feed element 320 and/or the second feed element 322 can be formed on a first surface (e.g., an X-Z plane). A second surface can be spaced apart, parallel to, and/or opposite the first surface (e.g., a second X-Z plane). At least a portion of antenna loop element 310 can be formed on the second surface. Additionally and/or alternatively, at least a portion of antenna loop element 310 can be formed on the first surface. Additionally and/or alternatively, at least a portion of antenna loop element 310 can be formed on a third surface (e.g., an X-Y plane) that is orthonormal to the first surface and/or the second surface. For example, in some embodiments, the antenna loop element 310 is formed contiguously on the first surface, the second surface, and the third surface. For example, the three-dimensional folded-loop element can be made by bending a planer folded loop element twice to cover the three surfaces. As one example, in some implementations, the antenna feed elements 320, 322 and/or a first portion of the antenna loop element 310 can be formed on the first surface. Additionally and/or alternatively, a second portion of the antenna loop element 310 can be formed on the second surface. Additionally and/or alternatively, a third portion of the antenna loop element 310 can be formed on the third surface. The first portion, second portion, and/or third portion can contiguously form at least a portion of, and/or the entirety of, the antenna loop element 310.

The antenna loop element 310 can be coupled to a ground structure 302 (e.g., a ground plane) by a first end portion 312 and/or a second end portion 314. For example, antenna loop element 310 can form a loop (e.g., a current loop) from first end portion 312 to second end portion 314. Ground structure 302 can be disposed coplanar with one or more surfaces of three-dimensional support structure 301. For instance, a plane formed by and/or forming ground structure 302 (e.g., a ground plane) can be coincident with a plane defined by three-dimensional support structure 301 upon which conductive elements in multifeed antenna system 300 are formed. For instance, as illustrated in FIG. 3A, first feed element 320 and second feed element 322 can be formed on an X-Z plane that is coplanar with ground structure 302. Additionally, at least a portion of the antenna loop element 310 (e.g., first end portion 312 and/or second end portion 314) can be coplanar with ground structure 302.

Figure 3B:
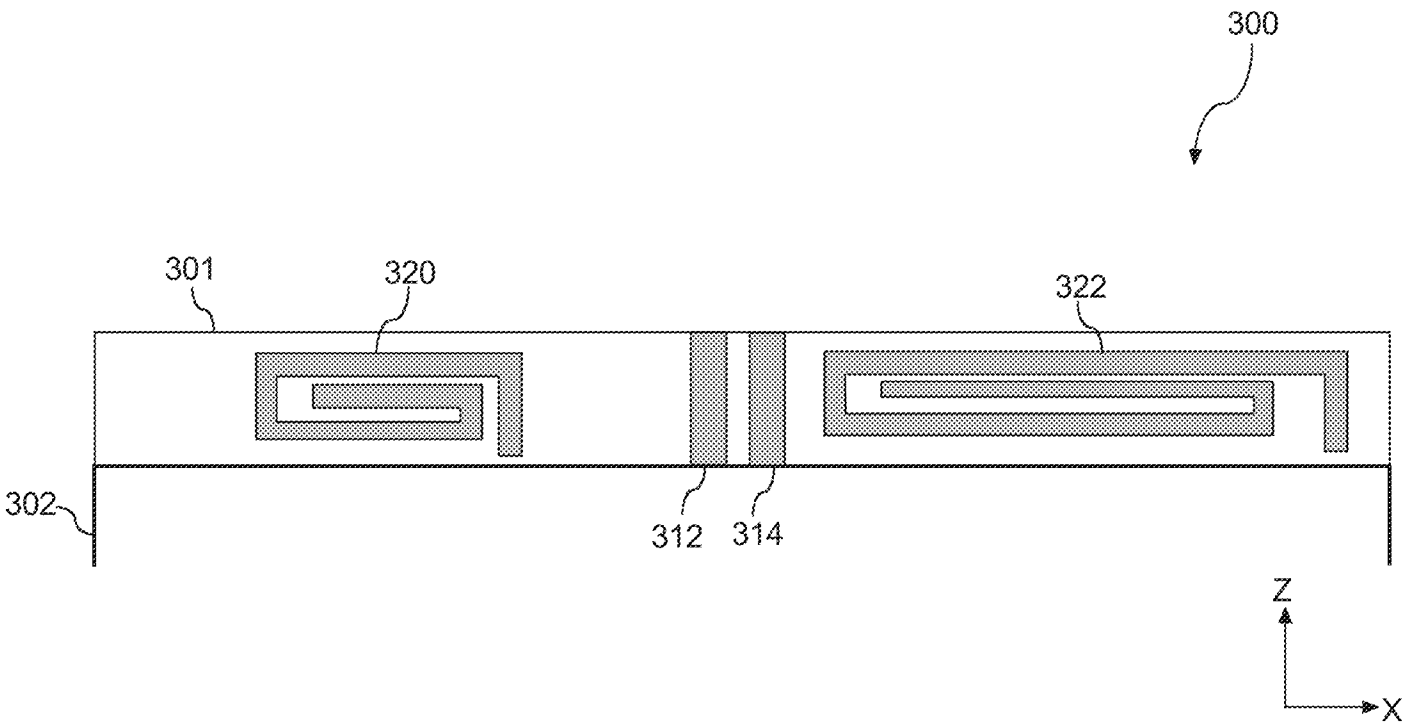
FIG. 3B illustrates a front profile view of the example three-dimensional multifeed antenna system of FIG. 3A according to example embodiments of the present disclosure.

FIG. 3B illustrates a front profile view of the multifeed antenna system 300 of FIG. 3A. For instance, as illustrated in FIG. 3B, the ground structure 302, first end portion 312, second end portion 314, and/or feed elements 320, 322 can be formed coplanar (e.g., on a same surface of three-dimensional support structure 301). For instance, as illustrated in FIG. 3B, each of the elements can be formed on an X-Z plane.

Shapes and dimensions of each segment, portion, etc. of the antenna loop element 310, the first feed element 320, and/or the second feed element 322, the width and length of each of the gaps for capacitive coupling, and/or other structural particulars of the elements can be designed based on design criteria, such as, for example, target resonances, bandwidths and/or other performance metrics. For instance, in some embodiments, shape and dimensions of each element and the width and length of each gap for capacitive can be are configured to provide resonances around the low band of 700-960 MHz region, such as covering the LTE/WCDMA/CDMA/GSM bands (e.g., at first feed element 320), and/or the high band of 1700-2700 MHz region, such as covering the DCS/PCS/UMTS/LTE bands (e.g., at second feed element 320).

Figure 4:
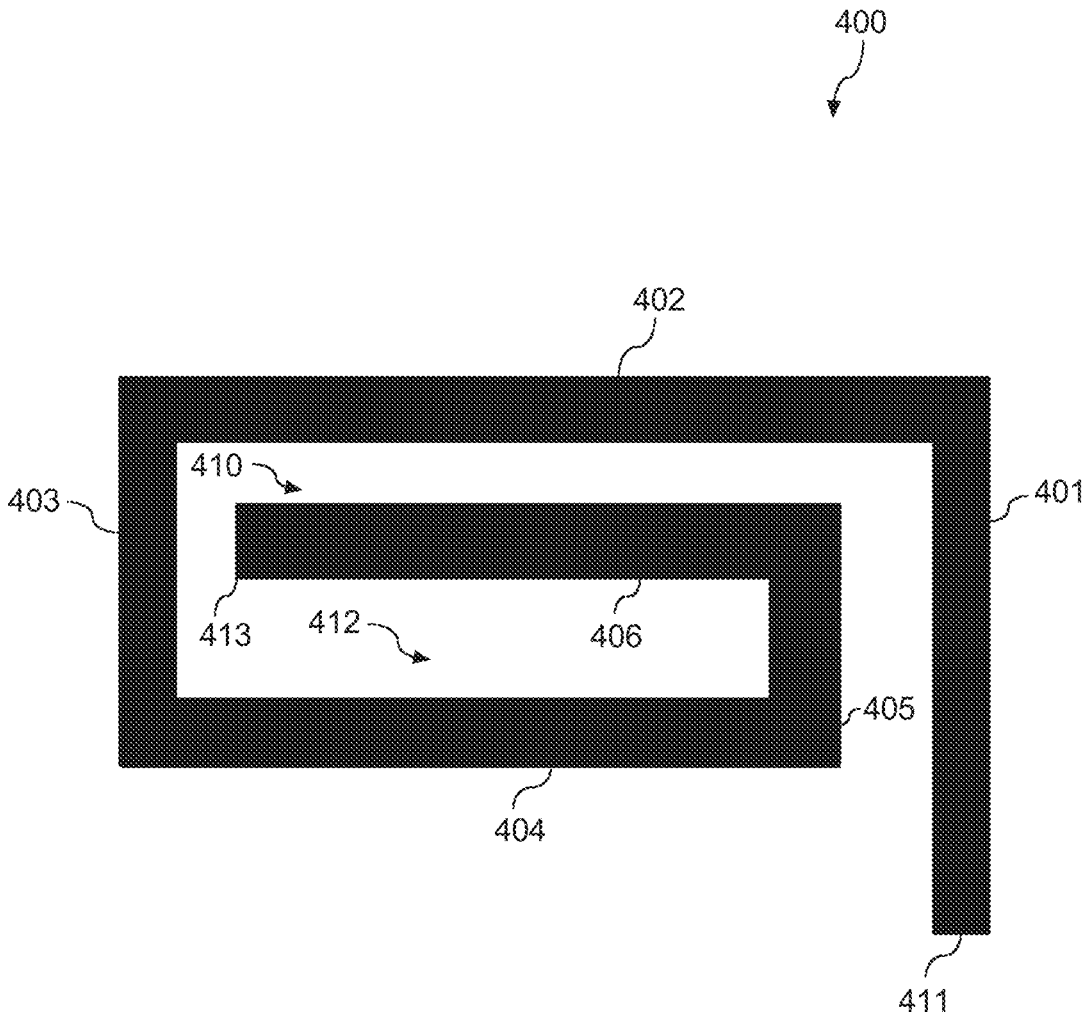
FIG. 4 illustrates a front profile view of an example feed element according to example embodiments of the present disclosure.

FIG. 4 illustrates a front profile view of an example feed element 400 according to example embodiments of the present disclosure. For instance, FIG. 4 depicts an example isolated magnetic dipole feed element 400. The feed element 400 may be employed in any of the multifeed antenna systems 100, 200, 300 of FIGS. 1-3B, such as any of feed elements 104, 112, 320, 322 of FIGS. 1-3B, in accordance with example aspects of the present disclosure. Additionally and/or alternatively, the feed element 400 can be employed in other suitable antenna systems according to example aspects of the present disclosure.

The feed element 400 can be formed of any suitable material, such as any suitable conductive material. For example, feed element 400 can be formed of metals, such as conductive metals, such as, for example, copper, iron, steel, gold, silver, any other suitable conductive metals, alloys thereof, and/or combinations thereof. The feed element 400 can be formed in any suitable manner in accordance with example aspects of the present disclosure. For example, the feed elements 400 can be formed of traces on a support structure, such as a substrate, three-dimensional support structure, etc. In some embodiments, the support structure can include conductive material, dielectric material, and/or insulating material. As another example, in some embodiments, the feed element 400 can be formed by removing portions of material from a sheet of material (e.g., conductive material). As another example, in some embodiments, the feed element 400 can be formed by welding, soldering, and/or otherwise attaching portions of material (e.g., conductive material).

The feed element 400 can include one or more conductor portions, such as a plurality of conductor portions (e.g., conductor portions 401-406), that are coupled and/or otherwise disposed (e.g., extending from another portion) to form the feed element 400. For example, feed element 400 can extend from a first end 411 (e.g., a feed end) to a second end 413 (e.g., a terminal end). For example, in some embodiments, the feed end can transmit and/or receive feed signals. For instance, feed signals (e.g., RF signals) can be provided to first end 411 (e.g., feed end) to induce radiated electromagnetic signals at the feed element 400. The radiated signals can interact with an antenna loop element (e.g., antenna loop elements 120, 310 of FIGS. 1-3B) to cause the antenna loop element to transmit signals for RF communications and/or other functions. Additionally and/or alternatively, RF signals received at the antenna loop element can induce electrical signals at feed element 400 that can be transmitted (e.g., by feed end) to RF circuitry. Additionally and/or alternatively, the first end 411 (e.g., feed end) can be coupled to one or more feed tuning elements.

For instance, feed element 400 can include first conductor portion 401. First conductor portion 401 can extend in a first direction. First conductor portion 401 can include first end 411. Additionally, feed element 400 can include second conductor portion 402. Second conductor portion 402 can extend from first conductor portion 401. Second conductor portion 402 can extend in a second direction. The second direction can be substantially perpendicular (e.g., within about 10 degrees of perpendicular) to the first direction. In some embodiments, second conductor portion 402 (e.g., the second direction) can be substantially parallel (e.g., within about 10 degrees of parallel) to a portion of an antenna loop element.

Additionally, feed element 400 can include third conductor portion 403. Third conductor portion 403 can extend from second conductor portion 402. Third conductor portion 403 can extend in a third direction. The third direction can be substantially opposite to (e.g., differing by about 180 degrees to) and/or opposite to the first direction. For instance, the third conductor portion 403 can be substantially parallel to and/or parallel to the first conductor portion 401.

Additionally, feed element 400 can include a fourth conductor portion 404. Fourth conductor portion 404 can extend from third conductor portion 403. Fourth conductor portion 404 can extend in a fourth direction. In some embodiments, the fourth direction can be substantially opposite to and/or opposite to the second direction. For instance, the fourth conductor portion 404 can be substantially parallel to and/or parallel to the second conductor portion 402.

Additionally, feed element 400 can include a fifth conductor portion 405. Fifth conductor portion 405 can extend from fourth conductor portion 404. Fifth conductor portion 405 can extend in a fifth direction. In some embodiments, the fifth direction can be about equivalent to and/or equivalent to the first direction. For instance, the fifth conductor portion 405 can be substantially parallel to and/or parallel to the first conductor portion 401 and/or the third conductor portion 403. For example, the fifth direction can be the first direction such that the fifth conductor portion 405 can extend in the first direction Additionally, feed element 400 can include a sixth conductor portion 406. Sixth conductor portion 406 can extend from fifth conductor portion 405. In some embodiments, sixth conductor portion 406 can be a terminal portion, such as including second end 413 (e.g., terminal end). Sixth conductor portion 406 can extend in a sixth direction. In some embodiments, the sixth direction can be about equivalent to and/or about equivalent to the second direction. For instance, the sixth conductor portion 406 can be substantially parallel to and/or parallel to the second conductor portion 402 and/or the fourth conductor portion 404. For example, the sixth direction can be the second direction such that the sixth conductor portion 406 can extend in the second direction.

It should be understood that, as used herein, a portion "extending" in a direction is used only for the purpose of illustration as describing a spatial arrangement between first end 411 and second end 413, by convention only. The description is not intended to refer to any necessary ordering, manufacturing process, etc. of the feed element 400. For instance, conductor portions can be considered to "extend" in a direction and/or an additional direction (e.g., an opposite direction) differing from the direction by 180 degrees.

In some embodiments, second conductor portion 402 can be a longest portion. For instance, a length (e.g., a longest dimension) of second conductor portion 402 can be greater than a length of other conductor portions (e.g., first conductor portion 401 and/or conductor portions 403-406). In some embodiments, first conductor portion 401 and third conductor portion 403 can have about equivalent lengths. In some embodiments, first conductor portion 401 can have a greater length than third conductor portion 403. In some embodiments, a length of fourth conductor portion 404 can be shorter than a length of second conductor portion 402. In some embodiments, a length of fifth conductor portion 405 can be shorter than a length of first conductor portion 401 and/or third conductor portion 403. In some embodiments, a length of sixth conductor portion 406 can be shorter than a length of second conductor portion 402 and/or fourth conductor portion 404. In some embodiments, a width (e.g., a shorter dimension) of each of the conductor portions 401-406 can be about equivalent. Additionally and/or alternatively, in some embodiments, one of the conductor portions 401-406 can have a different width from another of the conductor portions 401-406.

For instance, in some embodiments, the conductor portions can be arranged in a so-called "spiral" configuration to form a spiral feed element wherein each subsequent (e.g., as ordered from first end 411 to second end 413) portion in a corresponding direction (e.g., parallel conductor portions) has a shorter length than a preceding portion in the same (e.g., and/or opposite) direction. For instance, the spiral feed element can form a spiral airgap that extends (e.g., continuously) touching one or more sides of each of the nonterminal conductor portions 401-405 and three sides of the terminal portion (e.g., sixth conductor portion 406).

The feed element 400 can include one or more capacitively coupled regions (e.g. 410, 412). For instance, the feed element 400 can form capacitively coupled regions between parallel conductor portions of the feed element, such as parallel conductor portions in a direction having a longest length (e.g., the second direction, fourth direction, sixth direction). For example, first capacitively coupled region 410 can be formed between at least second conductor portion 402 and sixth conductor portion 406. Additionally and/or alternatively, second capacitively coupled region 412 can be formed between at least fourth conductor portion 404 and sixth conductor portion 406. The capacitively coupled regions 410, 412 can exhibit capacitive coupling for at least some frequencies even in the absence of external components (e.g., an antenna loop element). Additionally and/or alternatively, the capacitively coupled regions 410, 412 can increase capacitive coupling of the feed element 400 (e.g., second conductor portion 402) to an antenna loop element in accordance with example aspects of the present disclosure. For example, at least capacitively coupled regions (e.g., 410, 412) between conductor portions (e.g., 402, 404, 406) that are parallel to an antenna loop element can form capacitive coupling with the antenna loop element, which can, in some cases, increase overall capacitive coupling of the feed element 400 to the antenna loop element. As one example, if first end 411 is energized, the feed element 400 can form a capacitively-loaded magnetic dipole having high isolation (e.g., an isolated magnetic dipole).

As used herein, "about" in conjunction with a stated numerical value is intended to refer to within 10% of the stated numerical value.

Example embodiments are illustrated herein as having two feed elements, for the purposes of illustration only. One of ordinary skill in the art should understand that any suitable number of feed elements, such as, for example, three or more feed elements and/or only one feed element can be employed in accordance with example aspects of the present disclosure.

While the present subject matter has been described in detail with respect to specific example embodiments thereof, it will be appreciated that those skilled in the art, upon attaining an understanding of the foregoing can readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. An antenna system comprising:

an antenna loop element extending between a first end and a second end;

a first isolated magnetic dipole (IMD) antenna feed element capacitively coupled to the antenna loop element;

a second IMD antenna feed element capacitively coupled to the antenna loop element;

a first tuning element coupled to the first IMD antenna feed element, the first tuning element configured to vary an electrical characteristic at the first MID antenna feed element;

a second tuning element coupled to the second IMD antenna feed element, the second tuning element configured to vary an electrical characteristic at the second BID antenna feed element;

a third tuning element coupled to a ground structure and the first end of the antenna loop element, the third tuning element configured to vary an electrical characteristic at the antenna loop element; and a fourth tuning element coupled to the ground structure and the second end of the antenna loop element, the fourth tuning element configured to vary the electrical characteristic at the antenna loop element, wherein the first IMD antenna feed element includes one or more capacitively coupled regions forming at least a portion of capacitive coupling of the first IMD antenna feed element to the antenna loop element, and wherein the second IMD antenna feed element includes one or more capacitively coupled regions forming at least a portion of capacitively coupling of the second IMD antenna feed element to the antenna loop element.

2. The antenna system of claim 1, wherein the first IMD antenna feed element is associated with a first frequency and the second IMD antenna feed element is associated with a second frequency, the second frequency being different from the first frequency.

3. The antenna system of claim 2, wherein the first IMD antenna feed element is configured to filter the second frequency.

4. The antenna system of claim 1, wherein the first IMD antenna feed element and the second IMD antenna feed element are planar.

5. The antenna system of claim 1, wherein the first IMD antenna feed element and the second IMD antenna feed element each include a plurality of conductor portions comprising:

a first conductor portion extending in a first direction;

a second conductor portion extending in a second direction from the first conductor portion, the second direction being substantially perpendicular to the first direction;

a third conductor portion extending in a third direction from the second conductor portion, the third direction being substantially opposite to the first direction;

a fourth conductor portion extending in a fourth direction from the third conductor portion, the fourth direction being substantially opposite to the second direction;

a fifth conductor portion extending in the first direction from the fourth conductor portion; and a sixth conductor portion extending in the second direction from the fifth conductor portion;

wherein a first capacitively coupled region is formed between the second conductor portion and the sixth conductor portion; and wherein a second capacitively coupled region is formed between the fourth conductor portion and the sixth conductor portion.

6. The antenna system of claim 5, wherein the second conductor portion is substantially parallel to the antenna loop element.

7. The antenna system of claim 5, wherein a width of each of the plurality of conductor portions is equivalent.

8. The antenna system of claim 5, wherein the first conductor portion comprises a feed end, the feed end coupled to RF circuitry and configured to receive and transmit feed signals at the RF circuitry.

9. The antenna system of claim 1, wherein the ground structure comprises a ground plane.

10. The antenna system of claim 1, wherein the first IMD antenna feed element is separated from the antenna loop element by a first gap having a first width, and wherein the second IMD antenna feed element is separated from the antenna loop element by a second gap having a second width, the second width being different from the first width.

11. The antenna system of claim 1, wherein the first IMD antenna feed element, the second IMD antenna feed element, and the antenna loop element are formed on a substrate.

12. The antenna system of claim 1, wherein the first IMD antenna teed element, the second IMD antenna feed element, and the antenna loop element are formed on a three-dimensional support structure.

13. The antenna system of claim 12, wherein the three-dimensional support structure comprises:

a first surface;

a second surface opposite the first surface; and a third surface that is orthonormal to the first surface and the second surface;

wherein the first IMD antenna feed element, the second IMD antenna feed element, and a first portion of the antenna loop element is formed on the first surface, wherein a second portion of the antenna loop element is formed on the second surface, and wherein a third portion of the antenna loop element is formed on the third surface.

14. The antenna system of claim 1, further comprising:

RF circuitry coupled to the first IMD antenna feed element and the second IMD antenna feed element.

* * * * *